US005472587A

United States Patent [19]

Bischoping et al.

[11] Patent Number: 5,472,587

[45] Date of Patent: Dec. 5, 1995

[54] BRUSHLESS ELECTROFORMING APPARATUS

[75] Inventors: Patricia Bischoping, Webster; Robert P. Altavela, Farmington; Lawrence Kotowicz, Rochester; Peter J. Schmitt, Ontario; William G. Herbert, Williamson, all of N.Y.; Ronald E. Jansen, Palm City, Fla.; John H. Lennon, Canandaigua, N.Y.; Henry G. Grey, Las Vegas, Nev.

[73] Assignee: Xerox Corporation, Stamford, Conn.

[21] Appl. No.: 201,951

[22] Filed: Feb. 25, 1994

[51] Int. Cl.[6] ..... C25D 17/00

[52] U.S. Cl. ..... 204/212; 204/219

[58] Field of Search ..... 204/219, 212; 205/67, 73

[56] References Cited

U.S. PATENT DOCUMENTS

| | | | |
|---|---|---|---|
| 2,867,574 | 1/1959 | Berry | 204/212 |
| 3,844,906 | 10/1974 | Bailey et al. | 204/9 |
| 3,876,510 | 4/1975 | Wallin et al. | 204/9 |
| 3,954,568 | 5/1976 | DuPree | 205/73 |

*Primary Examiner*—John Niebling
*Assistant Examiner*—Brendan Mee
*Attorney, Agent, or Firm*—Zosan S. Soong

[57] ABSTRACT

An apparatus is disclosed for depositing metal on a mandrel which provides a brushless electrical current continuity between the mandrel and a current source, comprising: (a) a metal deposition vessel; (b) an electrode disposed in the vessel; (c) a mandrel disposed in the vessel, spaced apart from the electrode; (d) an electrically conductive liquid disposed in the vessel; (e) an electrolytic solution disposed in the tank; (f) a layer of a substantially electrically non-conductive material disposed between the electrolytic solution and the conductive liquid; and (g) connecting means for electrically connecting the mandrel and the conductive liquid, coupled to the mandrel.

18 Claims, 1 Drawing Sheet

BRUSHLESS ELECTROFORMING APPARATUS

CROSS REFERENCE TO RELATED COPENDING APPLICATION

Attention is directed to the following related application filed concurrently: Patricia Bischoping et al., "Brushless Electrodeposition Apparatus" Ser. No. 08/20/952), the disclosure of which is totally incorporated by reference.

BACKGROUND OF THE INVENTION

This invention relates generally to a metal deposition cell and more particularly to a brushless electroforming apparatus employing a conductive liquid contact. The apparatus and processes described herein are illustrated primarily in the context of an electroforming process, but such apparatus and processes may be useful for other metal deposition processes including electroplating. The resulting electroformed articles are used for example as substrates in the fabrication of photoreceptors.

Electroforming apparatus often employ solid metal brushes and slip rings to provide current continuity between the current source and the mandrel. However, solid metal brushes are problematic: they eventually wear out which necessitates replacement; they may spark, and they may skip on the slip ring which would cause the voltage to fluctuate. This skipping and sparking also cause the slip ring to become pitted and bumpy (like what happens when a welding rod is touched against an electrically hot surface). The resulting pitting and bumpiness become a spot where a spark is generated each time a brush passes over it. Eventually the slip ring must be refinished (machined and often replated with silver). Another problem is that the brushes also pit which accelerates their wear and reduces their contact area which increases the contact voltage. If the contact voltage gets too high, the brush may burn causing instantaneous catastrophic failure. Indeed, the entire drive may be destroyed as well as the electrolyte. Note that solid nonslip systems also may exist where there is solid to solid contact. In addition, the mandrel is typically rotated during the electroforming process to nullify anode to cathode alignment perturbations and/or to obtain sufficient agitation to make it possible to deposit metal at an economical rate. However, conventional electroforming apparatus combine the mandrel rotation function with the current continuity function which increases the complexity of these systems, thereby causing a disproportionate amount of maintenance expense. Thus, there is a need for a brushless electroforming apparatus which minimizes wear, sparking skipping, and voltage fluctuations. There is also a need for a brushless electroforming apparatus which separates the mandrel rotation function and the current continuity function to minimize maintenance expense.

Various electroforming apparatus and processes are known: Bailey et al., U.S. Pat. No. 3,844,906 and Wallin et al., U.S. Pat. No. 3,876,510.

SUMMARY OF THE INVENTION

It is an object of the present invention to provide a brushless apparatus employing a conductive liquid contact to enable current continuity between the mandrel and the current source in a metal deposition process.

It is another object in embodiments to provide a brushless electroforming apparatus which enables a constant and uniform electrical contact between the mandrel and the current source to substantially reduce or eliminate voltage fluctuations.

It is a further object to provide a brushless electroforming apparatus which separates the mandrel rotation function and the current continuity function.

It is an additional object to provide in embodiments a brushless electroforming apparatus employing a conductive liquid contact which does not wear out, spark, or skip.

These objects and others are accomplished in embodiments by providing an apparatus for depositing metal on a mandrel which provides a brushless electrical current continuity between the mandrel and a current source, comprising: (a) a metal deposition vessel; (b) an electrode disposed in the vessel; (c) a mandrel disposed in the vessel, spaced apart from the electrode; (d) an electrically conductive liquid disposed in the vessel; (e) an electrolytic solution disposed in the tank; (f) a layer of a substantially electrically nonconductive material disposed between the electrolytic solution and the conductive liquid; and (g) connecting means for electrically connecting the mandrel and the conductive liquid, coupled to the mandrel.

BRIEF DESCRIPTION OF THE DRAWINGS

Other aspects of the present invention will become apparent as the following description proceeds and upon reference to FIG. 1 which represents a schematic, elevational, sectional view of a preferred embodiment of a brushless electroforming apparatus.

DETAILED DESCRIPTION

Figure 1:
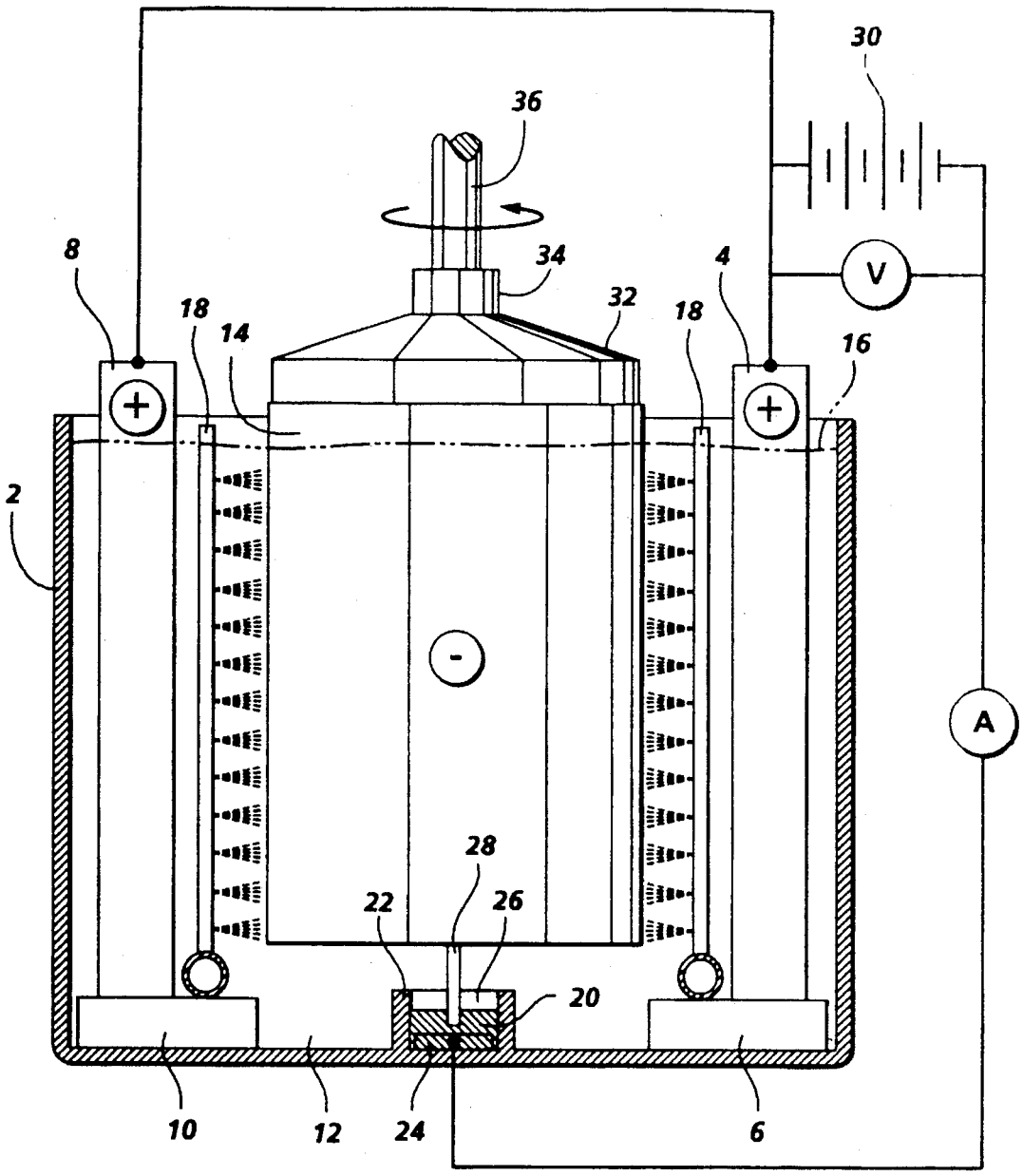

FIG. 1 discloses electroforming vessel or tank 2 containing first anode electrode 4 with optional corresponding first anode support 6, optional second anode electrode 8 with a second anode support 10. Channel 12 is formed between first anode electrode 4 and second anode electrode 8. Mandrel 14 is disposed in the center of channel 12 and is coupled to a hollow hanger 32, which is joined to a coupling 34. Drive shaft 36 may be coupled to coupling 34 to provide rotation of mandrel 14 and/or movement of mandrel 14 through channel 12. The mandrel 14 is preferably electrically insulated from drive shaft 36 by providing an electrically insulating barrier (not shown) between the hanger 32 and mandrel 14. Tank 2 contains a sufficient quantity of electroforming solution 16. Manifold 18 provides agitation to electroforming or electrolytic solution 16. Electrically conductive liquid 20 is disposed at the bottom of a receptacle, which is preferably in the form of trough 22. In FIG. 1, the walls of trough 22 extend above the floor of tank 2. To facilitate electrical connection with current source 30, optional conductive plate 24 is present at the bottom of trough 22 and conductive plate 24 is covered by conductive liquid 20. Layer 26 of a substantially electrically nonconductive material overlays conductive liquid 20. Layer 26 separates electroforming solution 16 from conductive liquid 20. To electrically connect mandrel 14 and conductive liquid 20, connecting means 28, which may be in the form of a conductive metal rod, has one end coupled to mandrel 14 and has the other end disposed in conductive liquid 20. Connecting means 28 penetrates through substantially nonconductive layer 26 to provide current continuity between mandrel 14 and current source 30 to render the mandrel preferably cathodic. Layer 26 and conductive liquid 20 are preferably disposed below the mandrel.

In another embodiment, trough 22 is absent and conductive liquid 20 is in the form of a layer that occupies the floor of tank 2 where conductive liquid 20 contacts the sides of the anode supports (6,10). Layer 26 of substantially nonconductive material covers the entire layer of conductive liquid 20 to separate electroforming solution 16 and conductive liquid 20. Connecting means 28 contacts conductive liquid 20 in the same manner as described herein.

In an alternate embodiment, conductive liquid 20 and layer 26 are disposed in a depression in the floor of tank 2, rather than disposed in trough 22 extending above the floor of tank 2 as depicted in FIG. 1. In this alternate embodiment, the depression is of an effective shape, and preferably is trough-shaped.

In embodiments, the brushless electroforming apparatus as illustrated in FIG. 1 operates as follows. A direct current source 30 is coupled to the electroforming apparatus to apply current between the anode and the cathode, wherein the anodic portion of the electrolytic cell comprises first anode electrode 4 and second anode electrode 8, and the cathodic portion of the electrolytic cell comprises mandrel 14 and conductive liquid 20. Current passes through conductive liquid 20 to mandrel 14 via connecting means 28 to render mandrel 14 cathodic. Mandrel 14 is rotated during the electroforming process, preferably prior to the deposit of any metal to the surface thereof. Preferably, connecting means 28 is not fixedly coupled to trough 22 to inhibit rotation of mandrel 14. In embodiments, a transport device coupled for example to drive shaft 36 moves mandrel 14 through channel 12 which causes the coupled connecting means 28 to move through conductive liquid 20 and substantially nonconductive layer 26. Layer 26 preferably reforms after passage of connecting means 28 to maintain separation of conductive liquid 20 and electroforming solution 16.

Unlike conventional solid metal brushes which eventually wear out due to a rubbing contact with a slip ring, connecting means 28, substantially nonconductive layer 26, and conductive liquid 20 seldom if ever need to be replaced since there is no significant rubbing contact therebetween, thereby minimizing maintenance costs. Moreover, as long as the end of connecting means 28 remains in contact with conductive liquid 20, the liquid nature of the conductive liquid generally ensures constant and uniform electrical contact with the end of the connecting means, thereby minimizing or eliminating sparking, skipping, and voltage variations, problems which may occur with solid metal brushes. In addition, the instant brushless invention reduces maintenance costs as compared with a conventional apparatus employing brushes. A system using brushes requires periodic adjustment of the tension on the brushes. The present system does not need adjustment of the tension on the brushes since the invention involves a brushless system. Also, the brushes must be springloaded so that they will maintain contact with the slip ring and that this contact, under pressure, requires additional force to allow rotation, thereby requiring a larger motor. More moving parts also means more friction which adds to the load, again requiring larger motors. Maintenance costs are reduced by separating the mandrel rotation function and the current continuity function due to the reduction in the number of moving parts and the reduction in the load on the system.

Although the electrodes (4,8) may comprise the cathode and the mandrel may comprise the anode of electroforming tank 2, the preferred configuration is where the electrodes (4,8) comprise the anode and the mandrel comprises the cathode.

The electroforming tank may be of any suitable design. Preferably, the electroforming tank is lined with a substantially electrically nonconductive material such as rubber or plastic having an effective thickness of for example 5 mm to about 2 cm.

An anode support is optionally employed to adjust the height of the anode to approximate the vertical length of the mandrel. This is done to minimize end effects which may occur when the anode extends beyond the end of the mandrel. The phrase end effects refers to a formed article having a thickness greater on the ends. A larger current density may result when the anode extends beyond the mandrel end, thereby possibly effecting additional metal deposition on the mandrel end to create an formed article of nonuniform thickness. The anode support is preferably fabricated from a substantially electrically nonconductive material such as plastic.

The conductive plate positioned in the trough and used to facilitate electrical connection with the current source may be fabricated from for example a metal such as copper, zinc, silver, stainless steel, gold, aluminum, and the like. The conductive plate may be of an effective dimension depending on the material employed. For example, if copper were used, the conductive plate preferably has a cross sectional area of from about 0.0009 to 0.0020 square inches per amp. If another material is used, the size is adjusted according to that material's conductivity; for instance, aluminum preferably requires a larger cross section and silver preferably requires less. It is preferred that the conductive plate does not dissolve in or react with the conductive liquid used (e.g., silver and gold form amalgams with mercury).

The mandrel may be of any effective configuration with the mandrel being hollow or solid in embodiments. The mandrel may have any suitable cross sectional shape including cylindrical and oval. Mandrels similar to those illustrated in Herbert et al., U.S. Pat. No. 4,902,386, may be employed, the disclosure of which is hereby totally incorporated by reference. Preferred mandrels have the following dimensions: A length ranging from about 5 to about 100 cm; an outside cross sectional dimension ranging from about 10 mm to about 100 cm.

The conductive liquid may be a metal which is a liquid at preferably below room temperature such as at about 20° C. (room temperature being about 25° C.), or which is a solid at room temperature and that liquifies when subjected to an elevated temperature ranging for example from above 25° to about 200° C. Thus, in embodiments, the conductive liquid may be subjected to elevated temperatures if the material is of the type that liquifies only at elevated temperatures. Preferred metals include mercury, gallium, and low melt alloys such as those listed herein:

| MELTING POINT °C. | ALLOY Composition, wt % |
|---|---|
| 10.7 | Ga, 62.5; In, 21.5; Sn, 16.0 |
| 17 | Ga, 82.0; Zn, 6.0; Sn, 12.0 |
| 46.5 | Sn, 10.65; Bi, 40.63; Pb, 22.11; In, 18.1; Cd, 8.2 |
| 60.5 | In, 51.0; Bi, 32.5; Sn, 16.5 |
| 70 | Bi, 50.0; Pb, 25.0; Sn, 12.5; Cd, 12.5 |
| 70 | In, 67.0; Bi, 33.0 |
| 95 | Bi, 52.5; Pb, 32.0; Sn, 15.5 |
| 100 | Bi, 50.0; Pb, 30.0; Sn, 20.0 |
| 109 | Bi, 50.0; Pb, 28.0; Sn, 22.0 |
| 117 | In, 52.0; Sn, 48.0 |
| 123 | Bi, 46.1; Pb, 19.7; Sn, 34.2 |

In embodiments, the conductive liquid may be silver oxide powder in air or carbon powder in water. However, carbon powder in water may not carry much current without heating up and melting which may be undesirable.

Effective amounts of the conductive liquid is employed ranging for example from about 20 grams to about 50 kilograms. The conductive liquid may be of an effective density, which preferably ranges from about 2 to about 15 grams/cm$^3$. In embodiments, the conductive liquid exceeds the density of the substantially nonconductive material by at least 0.1 gram/cm$^3$, and more particularly by at least about 0.3 to about 5 gram/cm$^3$. Preferably, the conductive liquid has a resistivity ranging for example from about $1\times10^{-9}$ to about $1\times10^{-11}$ ohm cm, and more preferably from about $1\times10^{-10}$ to about $5\times10^{-10}$ ohm cm. The conductive liquid may be in the form of a layer of an effective thickness, which ranges for example from about 3 mm to about 5 cm.

The layer of the substantially electrically nonconductive liquid or powder may be of any suitable material including, for example, porcelains, glass, mica, alumina, various high polymers (e.g., epoxies, polyethylene, polystyrene, phenolics), polyvinyl chloride resin, polytetrafluoroethylene, fluorinated ethylene-propylene resin, neoprene, askarel, and the like. Any liquid or finely divided powder with sufficient density, inertness, and insulating properties may be used. For example, the nonconductive liquid or powder will neither float in the electrolyte nor sink into the conductive liquid. The term "powder", refers to solid material of small particle size ranging for example from about 3 to about 300 microns, and preferably from about 10 to about 100 microns in cross sectional dimension. The powder may be in any effective shape including granules, flakes, beads, and the like. The substantially nonconductive material may have an effective density, preferably ranging from about 1.3 to about 6 grams/cm$^3$. In embodiments, the substantially nonconductive material has a density less than the density of the conductive liquid such that the material floats on top of the conductive liquid. The layer of the substantially nonconductive liquid or powder has an effective thickness, which preferably ranges from about 3 mm to about 5 cm. The substantially nonconductive material may be in the form of a single layer or multiple layers (e.g., 2, 3, or 4, and the like), wherein each layer of the multiple layer configuration is comprised of the same or different composition.

The phrase "substantially electrically nonconductive" as used herein for layer 26, the coating for connecting means 28, the lining of tank 2, the receptacle or trough 22, and the like, refers to any of the materials disclosed herein having a resistivity ranging for example from about $1\times10^{-6}$ to about $1\times10^{-18}$ ohm cm. The phrase "substantially electrically nonconductive" encompasses nonconductive materials having a resistivity ranging for example from about $1\times10^{-11}$ to about $1\times10^{-18}$ ohm cm.

In embodiments, the densities of the conductive liquid and the substantially nonconductive layer exceed the density of the electrolytic solution by an effective amount, and preferably by least 0.1 gram/cm$^3$, and more particularly by at least about 0.3 to about 5 gram/cm$^3$. The electrolytic solution may be of an effective density, which preferably ranges from about 1 to about 2 grams/cm$^3$.

In embodiments, to maintain separation, the conductive liquid is substantially immiscible with the substantially nonconductive material, and the electrolytic solution is substantially immiscible with the substantially nonconductive material.

To prevent direct electrical connection between the conductive liquid and the anode electrodes, any effective configuration may be employed. For example, the conductive liquid may be disposed in a receptacle which may be comprised of a substantially electrically nonconductive material, or which may be spaced apart from the anode electrodes, or both. In embodiments, the receptacle may be separated by an effective gap from the anode electrodes, preferably ranging from about 1 cm to about 20 cm. The receptacle may be fabricated entirely from the substantially nonconductive material or may comprise only a lining of such material. Suitable substantially nonconductive materials include rubber, plastic and the other substantially nonconductive materials disclosed herein. The receptacle may be for example a trough which may extend along a portion, and preferably the entire length of the channel. Illustrative dimensions of the trough are a length ranging from about 20 cm to about 100 cm, a width ranging from about 1 cm to about 10 cm, and a depth ranging from about 1 cm to about 10 cm. Alternatively, where movement of the mandrel through the channel is not desired during the electroforming process, the receptacle may be in the form of a bucket, which is of an effective size and shape, and preferably has a cross sectional dimension ranging from about 3 cm to about 10 cm, and a depth ranging from about 1 cm to about 10 cm. The level of the conductive liquids in the receptacles may be any effective value, and preferably ranging from about ⅕ to about ½ the height of the receptacle.

The drive shaft may be coupled directly or indirectly to the mandrel by any effective means including for instance a shaft which couples to the mandrel interior or to the end of the mandrel, a gripping arm which holds the mandrel from the exterior, or an annular holding chuck which holds the mandrel from the interior or the exterior. In addition, the drive shaft may be coupled to the mandrel via a coupling device and a hanger as illustrated in FIG. 1. The drive shaft rotates the mandrel at an effective speed, and preferably ranging from about 1 to about 15 feet per second.

The mandrel may be moved through the channel as well as through the different cells of the metal deposition cycle by any suitable transport device. An electroforming cycle is comprised of different cells such as the preheat cell, the metal deposition tank which is described herein, the solution recovery cell, and the cooling cell. A typical electroforming cycle is illustrated in Bailey et al., U.S. Pat. No. 3,844,906, the disclosure of which is totally incorporated by reference. The transport device may comprise for example transporting arms or a conveyor belt, especially continuous, preferably employed with a cam to move the coated or uncoated mandrels up, down, and through the various cells of the metal deposition cycle, of which the electroforming cell or tank illustrated in the instant FIG. 1 typically constitutes only a single stage in the cycle. The transport device may be coupled to the rotation means or even directly to the mandrel in embodiments. The transport device may move the mandrel at an effective speed through the channel, and preferably at a speed ranging from about 5 mm per minute to about 5 cm per minute. Since the connecting means is coupled to the mandrel in embodiments, the connecting means moves at the same speed as the mandrel, such that the connecting means travels through the nonconductive or poorly conductive layer and the conductive liquid at a speed preferably ranging from about 5 mm per minute to about 5 cm per minute.

The connecting means may be any suitable apparatus to provide electrical continuity between the mandrel and the conductive liquid. For example, the connecting means may be a conductive, solid or hollow metal rod fabricated preferably from a suitable metal such as stainless steel, copper, zinc, iron, aluminum, nickel, and the like. In embodiments, the connecting means may be a plastic pipe filled with a conductive liquid such as those described herein. In embodiments, the connecting means may comprise multiple wires such as two, three, four, five or more. The connecting means has an effective thickness for transmitting current, and preferably has an outer cross sectional dimension ranging from about 5 mm to about 5 cm. In embodiments, an effective portion of the connecting means has a substantially electrically nonconductive coating to prevent metal deposition from the electrolytic solution. In embodiments, the coating covers the portion of the connecting means exposed to the electrolytic solution, and preferably the coating covers from about ⅓ to about ¾ the surface area of the connecting means. The substantially nonconductive coating may comprise rubber, plastic, or any of the other substantially nonconductive materials disclosed herein.

The anode (first and second anode electrodes) may be fabricated from any suitable material and is of any effective design. In embodiments, the anode may be wholly or partially consumed in the metal deposition process by being fabricated from a material which is used to replenish the electrolytic bath to replace the metal being electrodeposited out of solution. However, it is preferred that the anode is fabricated from a material which is not consumed by the process. In such situations, the anode may be for example a basket containing a bath replenishment metal and is fabricated from a metal such as titanium which is typically not consumed in the metal deposition process. The basket may incorporate openings to permit flow of metal ions from the basket into the bath. The anode optionally contains a fabric anode bag made from a suitable material such as nap polyolefin to hold the bath replenishment metal. The fabric anode bag is preferably open at the top to allow addition of bath replenishment metal. The anode may have any effective shape and is preferably straight sided.

The channel defined by the anodes may be of any appropriate width, length, and height for a metal deposition process. The channel has the following illustrative dimensions: a width ranging from about 5 to about 150 cm; a length ranging from about 20 cm to about 15 meters; and a height ranging from about 3 cm to about 2 meters.

The voltage and the current density supplied by the DC source may be any effective value, and preferably range from about 10 to about 25 volts and from about 20 to about 600 amperes per square foot of mandrel surface.

The deposition metal which forms for example the electroformed article may be any metal conventionally used in electroforming and electroplating including nickel, sulfur depolarized nickel, and carbonyl nickel.

A preferred electroforming or plating solution is as follows: Total Deposition Metal (such as nickel): 8.0 to 17.0 oz/gal (the recited concentration for the Total Deposition Metal refers to the metal in solution);

Deposition Metal (M) Halide (X) as $MX_2.6H_2O$: 0.5 to 3.0 oz/gal;and Buffering Agent (such as $H_3BO_3$): 4.5 to 6.0 oz/gal.

Optionally, there is continuously charged to said solution about 1.0 to $2.0\times 10^{-4}$ moles of a stress reducing agent per mole of deposition metal electrolytically deposited from the solution. The metal halide may be any suitable compound typically used in electroforming solutions including nickel chloride, nickel bromide, and nickel fluoride.

For continuous, stable operation with high throughput and high yield of acceptable electroformed articles, a nickel sulfamate solution is preferred and is maintained at an equilibrium composition within the electroforming zone. The preferred nickel sulfamate solution comprises: Total Nickel (the recited Total Nickel concentration refers to the nickel ions in solution): 11.0 to 12.0 oz/gal;

Chloride as $NiCl_2.6H_2O$: 1.6 to 1.7 oz/gal; $H_3BO_3$: 5.0 to 5.4 oz/gal; pH: 3.8 to 4.1; and Surface Tension: 33 to 37 dynes/cm$^2$ as determined by a surface tensionometer.

Additionally, from about 1.3 to $1.6\times10^{-4}$ moles of a stress reducing agent per mole of nickel electrolytically deposited from the solution is continuously charged to the electroforming solution. Suitable stress reduction agents are sodium sulfobenzimide (saccharin), 2-methylbenzenesulfonamide, benzene sulfomate, naphthalene trisulfomate, and mixtures thereof.

The temperature of the electroforming or plating solution may be between about 100° and 160° F. and preferably is between about 135° and 145° F.

The metal deposited on the mandrel may be of an effective thickness, and preferably ranges from about 1 mm to about 3 cm in thickness. The formed article may be of any suitable shape including a cylinder and an endless belt. The formed article preferably is ductile, electrically conductive, and seamless, with a relatively high tensile strength of from about 90,000 to about 190,000 psi, and a ductility of between about 3 to 12%. In order to be suitable for use as a flexible substrate for the image retention surface in an electrostatographic apparatus, it is important that the formed article exhibits a high degree of thickness uniformity and a controlled degree of surface roughness. Generally, the surface roughness exhibited by the formed article ranges from about 1 to 80 microinches, RMS, and preferably, from about 10 to 35 microinches, RMS.

Further details of the electroforming solution, apparatus, and methods are illustrated in Bailey et al., U.S. Pat. No. 3,844,906 and Wallin et al., U.S. Pat. No. 3,876,510, the disclosures of which are totally incorporated byreference.

Other modifications of the present invention may occur to those skilled in the art based upon a reading of the present disclosure and these modifications are intended to be included within the scope of the present invention.

We claim:

1. An apparatus for depositing metal on a mandrel which provides a brushless electrical current continuity between the mandrel and a current source, comprising:

(a) a metal deposition vessel;

(b) an electrode disposed in the vessel;

(c) a mandrel disposed in the vessel, spaced apart from the electrode;

(d) an electrically conductive liquid disposed in the vessel;

(e) an electrolytic solution disposed in the vessel;

(f) a layer of a substantially electrically nonconductive material disposed between the electrolytic solution and the conductive liquid, wherein the substantially nonconductive material is a liquid or a powder; and (g) connecting means for electrically connecting the mandrel and the conductive liquid, coupled to the mandrel, wherein the connecting means penetrates through the layer of substantially electrically nonconductive material to contact the conductive liquid.

2. The apparatus of claim 1, wherein the connecting means comprises a hollow or solid conductive rod, wherein one end of the rod is disposed in the conductive liquid and the other end of the rod is coupled to the mandrel.

3. The apparatus of claim 1, wherein an effective portion of the connecting means has a substantially electrically nonconductive coating to prevent metal deposition from the electrolytic solution.

4. The apparatus of claim 1, wherein the substantially nonconductive material has a density ranging from about 1.3 to about 6 grams/$cm^3$.

5. The apparatus of claim 1, wherein the substantially nonconductive material is porcelain, glass, mica, alumina, epoxy, polyethylene, polystyrene, phenolic, polyvinyl chloride resin, polytetrafluoroethylene, fluorinated ethylene-propylene resin, neoprene, askarel, or a mixture thereof.

6. The apparatus of claim 1, wherein the layer of the substantially nonconductive material has a thickness ranging from about 3 mm to about 5 cm.

7. The apparatus of claim 1, wherein the electrode comprises the anode and the mandrel comprises the cathode.

8. The apparatus of claim 1, wherein the conductive liquid is in electrical association with the cathodic side of the current source.

9. The apparatus of claim 1, further comprising a rotation device, coupled to the mandrel, for rotating the mandrel.

10. The apparatus of claim 1, wherein the conductive liquid is a metal.

11. The apparatus of claim 1, further comprising a second electrode wherein the mandrel is disposed between the electrode and the second electrode.

12. The apparatus of claim 1, wherein the density of the conductive liquid exceeds that of the substantially nonconductive material by at least 0.1 gram/$cm^3$.

13. The apparatus of claim 1, wherein the electrically conductive liquid and the substantially nonconductive material are disposed in a receptable extending above the floor of the metal deposition tank.

14. The apparatus of claim 1, wherein the electrically conductive liquid and the substantially nonconductive material are disposed in a depression in the floor of the metal deposition tank.

15. The apparatus of claim 1, further comprising a transport device for moving the mandrel, wherein the coupled connecting means travels through the substantially nonconductive material and the conductive liquid at a speed ranging from about 5 mm per minute to about 5 cm per minute.

16. The apparatus of claim 1; wherein the substantially nonconductive material has a resistivity ranging from about $1\times10^{-6}$ to about $1\times10^{-18}$ ohm cm.

17. The apparatus of claim 1, wherein the substantially nonconductive material is nonconductive, having a resistivity ranging from about $1\times10^{-11}$ to about $1\times10^{-18}$ ohm cm.

18. The apparatus of claim 1, wherein the conductive liquid is disposed below the mandrel.

* * * * *